United States Patent [19]

Bader, Jr.

[11] Patent Number: 4,651,944

[45] Date of Patent: Mar. 24, 1987

[54] STRAP ACCUMULATOR

[75] Inventor: Robert J. Bader, Jr., McHenry, Ill.

[73] Assignee: Signode Corporation, Glenview, Ill.

[21] Appl. No.: 731,073

[22] Filed: May 6, 1985

[51] Int. Cl.[4] ..... B65H 20/24; B65H 75/00; G11B 15/56

[52] U.S. Cl. ..... 242/75.5; 226/118; 242/55

[58] Field of Search ..... 226/118; 242/55, 55.19 R, 242/55.18, 55.21, 75.5, 75.51, 105, 45; 100/26

[56] References Cited

U.S. PATENT DOCUMENTS

| | | | |
|---|---|---|---|
| 1,431,512 | 10/1922 | Clark | 242/55.18 |
| 1,929,568 | 10/1933 | Spowart . | |
| 2,044,569 | 6/1936 | Hess | 242/55.18 |
| 2,844,334 | 7/1958 | Luth . | |
| 2,989,355 | 4/1961 | Cannings . | |
| 2,994,903 | 8/1961 | Lawrance et al. . | |
| 3,058,689 | 10/1962 | Luth . | |
| 3,191,836 | 6/1965 | Reader . | |
| 3,258,213 | 6/1966 | Fronckowiak et al. . | |
| 3,428,792 | 12/1969 | Auld . | |
| 3,544,029 | 12/1970 | Meier . | |
| 3,693,859 | 9/1972 | Nielsen . | |
| 3,743,154 | 7/1973 | Brewitz . | |
| 3,758,012 | 9/1973 | Bonner et al. . | |
| 3,782,662 | 1/1974 | Miller | 242/55 |
| 3,929,298 | 12/1975 | Hara et al. . | |
| 3,946,921 | 3/1976 | Noguchi . | |
| 4,012,004 | 3/1977 | Tonellato . | |
| 4,448,362 | 5/1984 | Johnson | 242/55.19 R |
| 4,557,427 | 12/1985 | Johnson | 242/55 |

FOREIGN PATENT DOCUMENTS

| | | | |
|---|---|---|---|
| 930055 | 3/1962 | United Kingdom | 242/55.18 |

OTHER PUBLICATIONS

Figure 1 of West German Patent No. 3,335,964, forwarded to the Office with applicant's Disclosure Statement mailed Jan. 9, 1986.

Service Manual for Automatic Power Strapping Machine, Models ML2-EE, ML2-JE, & ML2-HG; Signode Corporation, Glenview, IL; pp. 1–41, revised Jun. 1980.

*Primary Examiner*—Stuart S. Levy
*Assistant Examiner*—Lynn M. Sohacki
*Attorney, Agent, or Firm*—Dressler, Goldsmith, Shore, Sutker & Milnamow, Ltd.

[57] ABSTRACT

A strap accumulator is disclosed for use between an associated strapping apparatus and a power-driven strap dispensing mechanism. The accumulator is configured to receive strap from the dispenser, with the accumulated strap being periodically withdrawn by the associated strapping apparatus. The accumulator includes a housing which defines an interior cavity within which strap is accumulated, with a disc-like strap guide mounted generally centrally of the cavity which guides strap from within the housing through one of the sidewalls thereof. The generally central mounting of the strap guide within the cavity permits the accumulated strap to form an elongated loop between the strap guide and an edge wall of the housing without any tendency to disfigure or damage the strap.

10 Claims, 6 Drawing Figures

FIG. 1
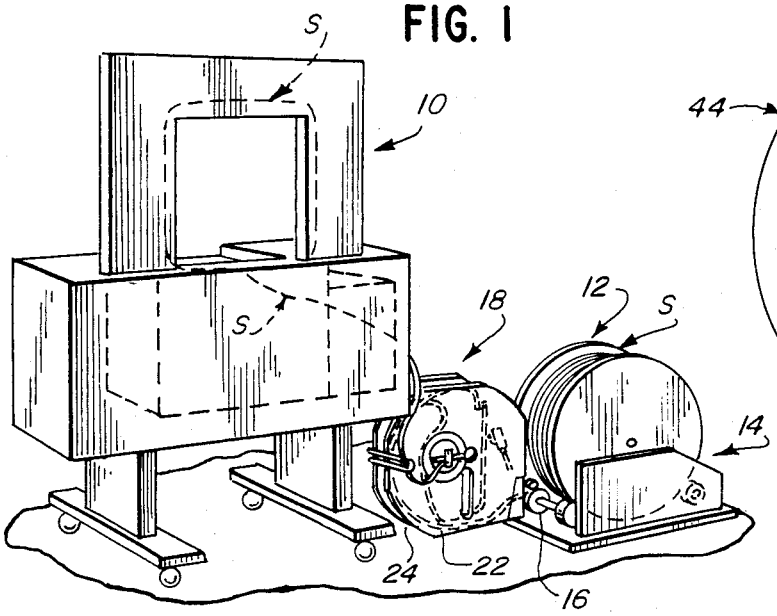
FIG. 6
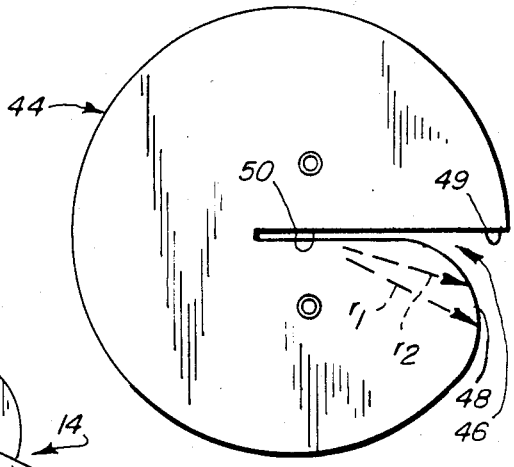
FIG. 4
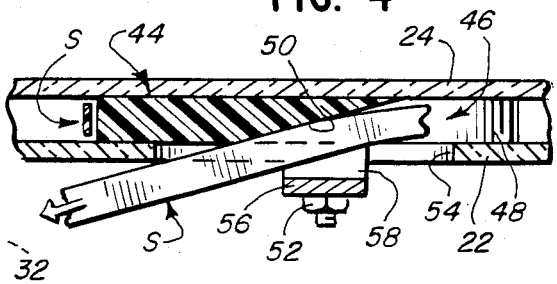
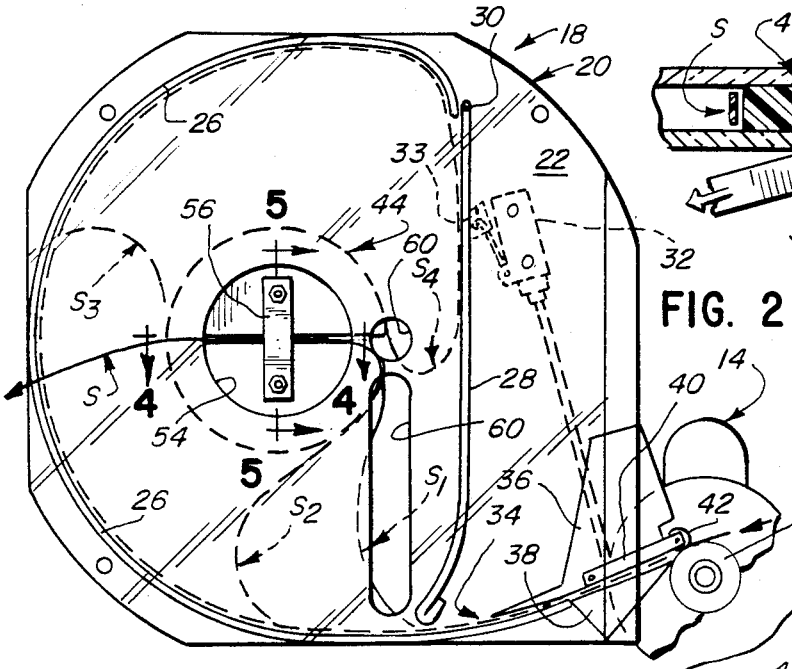
FIG. 2
FIG. 3
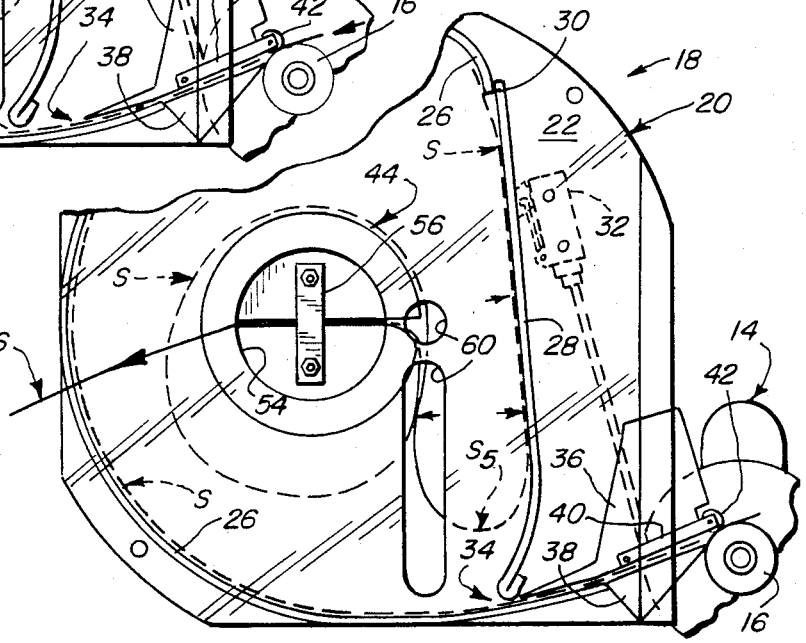
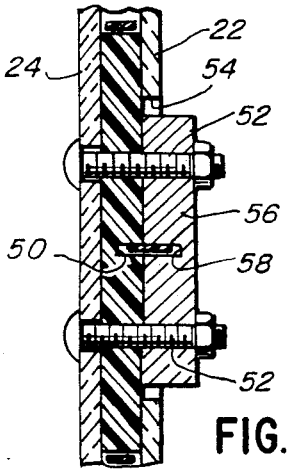
FIG. 5

STRAP ACCUMULATOR

TECHNICAL FIELD

The present invention relates generally to arrangements for forming and securing a loop of strap material about an object, and more particularly to a strap accumulator adapted to receive and accumulate strap from associated dispensing means for periodic withdrawal of the strap from the accumulator by an associated strapping apparatus.

BACKGROUND OF THE INVENTION

Various machines are known for forming a tensioned loop of strap material about one or more objects positioned in a packaging station to effect securement of the objects with the strap. Many devices of this nature are highly automated in operation, and function to quickly and efficiently form a loop of strap material about an object to be secured, with the loop subsequently tensioned into closely fitting relation with the object. Such devices further typically include means for overlapping the strap material and securing the strap to itself after it has been tensioned about the object, with the strap subsequently severed to permit the sequence of operations to be repeated.

To maximize the efficiency of such strapping devices, they are preferably configured to advance the strap material at a relatively high speed for the desired formation of the strap loop. However, one factor which can act to limit the speed with which the desired strap loop can be formed relates to the rate at which continuous strap material can be supplied to the apparatus. Such strap material is typically stored on a supply reel which can hold thousands of feet of the strap. Consequently, such a strap supply reel exhibits significant rotational inertia, thus resisting rapid acceleration for supply of strap to an associated strapping device during loop formation, and further resisting deceleration during portions of the strapping cycle when the strapping device does not require further strap delivery.

Because it is desirable to minimize the tension force which must be exerted by the strapping apparatus for drawing strap from its associated supply means, various arrangements have been devised for effecting periodic driven movement of a strap supply reel for dispensing strap therefrom. Although such power-driven strap dispensers facilitate the desired periodic supply of strap material to the strapping apparatus, the rotational inertia of the strap supply reel is ordinarily sufficiently large to prevent a power-driven dispenser from achieving the desired degree of strap acceleration and deceleration for efficient high speed operation of the associated strapping apparatus.

In view of this, it is desirable to provide a strap accumulator device intermediate a power-driven strap dispenser mechanism and the strapping apparatus. Strap accumulating devices of various configurations are known, with one typical configuration comprising a box-like enclosure configured to accumulate strap in a "randomly stuffed" manner. This type of accumulator can include a switching mechanism which is responsive to the quantity of strap within the accumulator, with the switching mechanism configured to operate an associated power-driven strap dispenser device. Such an arrangement functions such that strap is fed into the accumulator from the strap dispenser until the desired quantity of strap has been accumulated. Strap is withdrawn from the accumulator by the associated strapping apparatus, with the removal of strap acting to operate the switching mechanism, which in turn operates the strap dispenser for replenishment of strap within the accumulator. Strap is thus intermittently drawn from the accumulator by the strapping apparatus, and similarly intermittently fed into the accumulator by the strap dispensing device.

While an accumulator of the above description facilitates the desired rapid acceleration of strap material for supplying the associated strapping apparatus, friction generated between the surfaces of the randomly stuffed strap, and between the strap material and a capstan or like element about which the strap is guided as it leaves the accumulator, can undesirably act to limit the rate at which strap material can be accelerated, and in some instances can even result in jamming or other disruption during use.

Accordingly, it is desirable to provide a strap accumulator for use intermediate a strapping apparatus and a power-driven strap dispensing device which facilitates rapid acceleration of a sufficient quantity of strap material for efficient operation of the strapping apparatus. Preferably, such a strap accumulator should be readily manufactured and straightforward and reliable in operation, while at the same time minimizing the required tensile force which must be exerted on the strap material as it is accelerated and withdrawn from the accumulator by the strapping apparatus.

SUMMARY OF THE INVENTION

In accordance with the present invention, a strap accumulator is disclosed which is configured for receiving continuous strap from associated power-driven strap dispenser or like strap supply means, and for accumulating the strap for periodic withdrawal from the accumulator by an associated strapping apparatus without any tendency to disfigure or damage the strap. Notably, the present accumulator is desirably straightforward in construction for economical manufacture and reliable operation, and can be readily sized according to the requirements of the associated strapping apparatus. Significantly, the present accumulator functions in a manner which is distinct from previously known random stuffing arrangements in the way in which strap is accumulated therein without any disfigurement of or damage to the strap, and has been particularly configured to minimize friction which is generated as strap material is accelerated and withdrawn from the device.

In the illustrated embodiment, the present accumulator includes an accumulator housing having a pair of parallel, spaced-apart sidewalls, and a generally arcuate edge wall which extends between the sidewalls to define a generally, but not necessarily completely, circular cavity within the housing. The housing defines a strap infeed opening between the sidewalls through which strap is fed into the cavity from the associated power-driven strap dispenser. In the preferred form, the infeed opening is positioned such that strap is fed into the cavity along the surface of the arcuate edge wall of the housing.

The accumulator further includes a disc-like, generally circular strap guide element positioned generally centrally of the accumulator housing's cavity. The strap guide is fixedly mounted in position within the housing by securement to one of the sidewalls, and is configured to guide the continous strap from within the housing cavity outwardly of the housing through one of its sidewalls. To this end, the strap guide defines a mouth at its marginal edge into which strap within the cavity is fed, and further defines an inclined guide ramp communicating with the mouth for guiding the strap outwardly of the housing. In the preferred form, the mouth of the strap guide includes an arcuate guide surface (preferably of a decreasing radial dimension with respect to a central point of the strap guide), with the strap material moving along this arcuate guide surface as it is withdrawn from within the housing cavity by the associated strapping apparatus.

As noted, the present accumulator does not employ random stuffing for storage of strap therein, and thus, desirably avoids twisting or kinking of the strap material. More specifically, the construction is arranged such that a single elongated loop of strap can be formed within the housing cavity between the housing edge wall and the strap guide, and generally about the strap guide. Strap is initially fed into the accumulator such that the strap extends from the infeed opening into and through the strap guide. Attendant to further feeding of strap into the cavity along the edge wall of the housing, a loop is formed between the edge wall and the centrally mounted strap guide, with the "front" or apex of the loop tending to advance about the strap guide as strap feed continues. After the loop of strap is formed such that it extends substantially completely about the central strap guide, continued infeed of strap results in the "front" of the loop continuing to advance such that a "loop within itself" is formed.

Thus, but a single loop of strap is formed within the accumulator cavity in the sense that the strap defines only a single "front" or apex. Nevertheless, the desired quantity of strap material can readily be accumulated without making the accumulator excessively large by configuring the device to permit the single loop of strap to extend within itself.

The quantity of strap material stored within the accumulator preferably corresponds to the maximum amount of strap required for one full cycle of operation of the associated strapping apparatus. In order to regulate the amount of strap fed into the accumulator by the associated driven dispensing device, the accumulator includes a pressure switch arrangement for operation of the drive motor of the dispensing device. The switch mechanism includes an elongated, pivotally mounted pressure switch arm mounted between the sidewalls of the accumulator housing, with the pressure switch arm thus further defining the interior cavity of the accumulator housing. The switch arm acts to operate an associated electrical switch whereby the arrangement is operable in response to pressure exerted on the switch arm by strap accumulated within the housing cavity to signal the driven strap dispenser to discontinue feeding of strap into the cavity. Thus, the pressure switch mechanism intermittently operates for starting and stopping supply of strap to the accumulator.

Numerous other features and advantages of the present invention will become readily apparent from the following detailed description, the accompanying drawings, and the appended claims.

BRIEF DESCRIPTION OF THE DRAWINGS

FIG. 1 is a perspective view of a strapping apparatus, a power-driven strap dispensing mechanism, and a strap accumulator embodying the principles of the present invention operatively interposed therebetween;

FIG. 2 is a fragmentary, side elevational view of the strap accumulator illustrated in FIG. 1;

FIG. 3 is a fragmentary, side elevational view similar to FIG. 2 further illustrating the present strap accumulator and its operation;

FIG. 4 is a fragmentary cross-sectional view taken along line 4—4 of FIG. 2;

FIG. 5 is a fragmentary, cross-sectional view taken along line 5—5 of FIG. 2; and FIG. 6 is an enlarged, side elevational view of a strap guide element of the present accumulator construction.

DETAILED DESCRIPTION

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a strapping apparatus generally designated 10 for use with which the accumulator of the present invention is configured. As will be recognized by those familiar with the art, strapping apparatus 10 can have any of a wide variety of configurations, with the manner in which such devices function being well understood. Generally speaking, apparatus 10 operates to draw continuous strap material S from associated supply means, and form the strap material into a loop about one or more objects positioned within the packaging station of the apparatus. While the exact manner of operation can vary from one machine to another, the typical apparatus is configured to contract the strap of loop into tightly fitting relation with the one or more objects in the apparatus, and subsequently functions to overlap and join the strap to itself whereby the objects are tightly secured with the strap. The apparatus further functions to sever the strap material so that the desired strap loop can again be formed for another cycle of operation.

The strap material itself can vary in both thickness and width dimensions depending upon its desired use, and is typically formed from thermoplastic or like synthetic material, including but not limited to nylon, polyester and polypropylene. Efficient operation of strapping apparatus 10 is facilitated by providing an ample supply of the strap S, and to this end a strap supply reel 12 is typically employed for storing thousands of feet of strap. The supply reel 12 is configured for mounting in a power-driven strap supply or dispenser mechanism 14. The dispenser 14 is typically electrically-driven, and is intermittently operated for dispensing strap material from the supply reel. As illustrative of a typical strap dispensing device, mechanism 14 is shown as including a driven guide roller 16 which acts to drive strap material unreeled from supply reel 12. The dispenser 14 may be of any suitable conventional or special design and the specific design forms no part of the present invention.

To further facilitate efficient operation of strapping apparatus 10, it is desirable for a quantity of strap to be removed from supply reel 12 just prior to delivery of the strap material to the apparatus 10. To this end, an accumulator 18 embodying the principles of the present invention is operatively interposed between the dispenser mechanism 14 and the strapping apparatus 10. As will be further described, accumulator 18 is configured to receive and temporarily store a quantity of the continuous strap material, with the accumulated strap periodically withdrawn from the accumulator attendant to each cycle of operation of strapping apparatus 10.

Accumulator 18 includes a housing 20 comprising a pair of parallel, spaced-apart sidewalls 22 and 24. Sidewalls 22 and 24 are spaced apart by a dimension which is slightly larger than the width of strap S so that strap can move freely between the sidewalls. To facilitate inspection of the interior of the accumulator housing, at least one of its sidewalls is preferably formed from transparent material, and accordingly, sidewall 22 is shown as being transparent in the illustrated embodiment. For purposes of clarity, the strap material S shown in the various drawings is illustrated in "phantom line" when the strap is being viewed through transparent sidewall 22.

Accumulator housing 20 further includes an edge wall 26 which extends between sidewalls 22 and 24, with the edge wall 26 being preferably of an arcuate configuration whereby the housing defines a generally, but not necessarily perfectly, circular interior cavity within which strap material is accumulated. The cavity within the housing is further defined by an elongated pressure switch arm 28 positioned between housing sidewalls 22 and 24. Switch arm 28 is mounted for pivotal movement at 30, and is configured to operate an associated dispenser switch 32.

In the illustrated embodiment, switch 32 is shown mounted on the rear or outwardly facing surface of housing sidewall 24 (and thus is illustrated in phantom line), with the pressure switch arm 28 including a suitable portion extending through an opening 33 (see FIG. 2) in the sidewall 24 for operation of the switch 32. As will be further described, strap which is accumulated within the housing cavity exerts pressure on the switch arm 28 when the desired predetermined quantity of strap S has been accumulated. The pressure of the accumulated strap acts against the switch arm to operate dispenser switch 32, which signals the dispenser mechanism 14 to discontinue feeding of strap into the accumulator housing. Relief of pressure on the switch arm 28 (attendant to withdrawal of strap material from the accumulator by associated strapping apparatus 10) operates switch 32 to initiate feeding of strap material into the accumulator from dispenser mechanism 14.

Accumulator housing 20 defines a strap infeed opening 34 between sidewalls 22 and 24 adjacent to edge wall 26. The infeed opening is further preferably defined by an upper infeed guide 36 mounted on the accumulator housing in closely spaced relation to edge wall 26. A lower infeed guide 38 can also be provided to further define infeed opening 34.

The infeed guides 36 and 38 are preferably positioned in close association to the guide roller 16 of the strap dispenser mechanism 14. In the illustrated embodiment, a roller arm 40 is mounted on the upper infeed guide 36, and carries a back-up roller 42 which cooperates with roller 16 so that strap S is held captive between the rollers and can be advanced and fed into the accumulator 18 by driven rotation of roller 16.

As will be appreciated, the closely spaced positioning of upper infeed guide 36 to arcuate housing edge wall 26 guides the strap S into the accumulator generally along the edge wall. Significantly, strap material is withdrawn from within the accumulator 18 by apparatus 10 by passage through one of the accumulator housing sidewalls. This is accomplished by means of a strap guide element, generally designated 44, mounted generally between the sidewalls 22 and 24 generally centrally of the interior cavity of the accumulator housing.

With particular reference to FIGS. 4, 5, and 6, the strap guide 44 is preferably of a generally disc-like configuration, and defines a mouth 46 (FIG. 6) along one of its marginal edge portions. Strap from within the interior cavity of the accumulator housing is drawn into the mouth 46 and through the strap guide 44 by the associated strapping apparatus 10. Significantly, mouth 46 includes at least one arcuate guide surface 48 (see FIG. 6) along which the strap moves as it is drawn into and though strap guide 44. In the preferred form, the arcuate guide surface 48 is of a decreasing radial dimension with respect to a central point of the generally circular strap guide 44 (note indicated decreasing radii $r_1$ and $r_2$ in FIG. 6).

This preferred configuration of the strap guide 44 has been found to be significant in desirably reducing the force that must be exerted by strapping apparatus 10 attendant to withdrawal of strap material from the accumulator, thus desirably facilitating rapid acceleration of the strap material. The decreasing radial dimension of the guide surface 48 desirably acts to prevent the strap material from "locking" about the strap guide 44 attendant to strap acceleration and withdrawal, as can sometimes be a problem with accumulator devices having exit guide capstans or the like. While the opposite surface of mouth 46, designated 49, can be arcuately configured like guide surface 48, configuring surface 49 to extend radially of the strap guide 44 as illustrated is preferred. This arrangement desirably positions surface 49 to "overhang" guide surface 48, which has been found to desirably facilitate movement of the strap loop about strap guide 44 attendant to infeed of strap to the accumulator 18.

With further reference to FIGS. 4, 5, and 6, strap guide 44 further includes an inclined guide ramp 50 which is aligned and communicates with mouth 46 and which functions to guide strap material S from within the cavity of the accumulator housing and through one of the housing sidewalls. To this end, the strap guide 44 is fixedly mounted within the accumulator housing, and in the illustrated embodiment is secured to sidewall 24 by fasteners 52. To permit passage of the strap material S from within the housing 20, sidewall 22 defines an opening 54 which generally corresponds in size with the length of inclined guide ramp 50 of strap guide 44. In order to confine the strap S generally within the inclined guide ramp 50, a guide bridge 56 is preferably provided which spans the inclined guide ramp, with the guide bridge 56 defining a guide slot 58 (see FIGS. 4 and 5) aligned with the guide ramp 50 for guiding the passage of strap material from within the accumulator. The guide bridge 56 may be mounted in position with the fasteners 52 for simplicity of the construction.

The function and operation of accumulator 18 will now be described. With supply reel 12 mounted in dispenser mechanism 14, a free end of strap material S is threaded between rollers 16 and 42, and through infeed opening 34 between upper and lower infeed guides 36 and 38. The free end of the strap is next guided generally from the infeed opening 34 into the mouth 46 of strap guide 44, with openings 60 defined by sidewall 22 facilitating the manipulation of the strap in this manner.

After the free end of the strap has been inserted through strap guide 44, a sufficient quantity of strap is drawn from the supply reel 12 through the accumulator 18 to permit the required pre-operational threading of the strap into apparatus 10. It will be noted that in FIG. 2, reference character $S_1$ generally designates this initial positioning of the strap material between infeed opening 34 and mouth 46 of strap guide 44.

Upon initiation of strapping operations, dispenser mechanism 14 is operated to feed strap S into the accumulator 18. During feeding, the strap S does not move through strap guide 44, but rather moves along edge wall 26, and tends to form a loop which progresses about the strap guide 44. This action is illustrated by reference characters $S_2$, $S_3$, and $S_4$ in FIG. 2, which illustrates progression of the "front" or apex of the strap loop about the strap guide 44.

Notably, the configuration of accumulator 18 is such that only a single elongated loop of strap is formed between edge wall 26 and strap guide 44, that is, the loop being formed only defines one apex or "front". Accumulation of the desired quantity of strap is accommodated by permitting this single loop of strap to form a "loop within itself" (note the progression of the apex of the loop as indicated at $S_5$ in FIG. 3). Depending upon the specific application, the elongated strap loop can be formed to extend about strap guide 44 more than once (i.e., the apex or "front" of the loop progresses completely about strap guide 44 more than once attendant to strap infeed). Typically, the loop is wrapped within itself and around the strap guide 44 several times to provide a sufficient accummulation of strap within the accummulator B.

Feeding of strap into the accumulator continues until a predetermined quantity has been received therein, with this quantity corresponding to the maximum length of strap material required for a complete cycle of operation of the associated strapping apparatus 10. When the desired predetermined quantity of strap has been received by the accumulator, pressure exerted against switch arm 28 by the strap material pivots the switch arm outwardly to operate dispenser switch 32, which signals dispenser mechanism 14 to discontinue feeding of strap (see FIG. 3).

Strap S is withdrawn from the accumulator 18 attendant to the periodic operation of strapping apparatus 10. During operation, apparatus 10 periodically withdraws the strap material from within accumulator 18 via the strap guide 44. As noted, the configuration of the strap guide 44 avoids generation of excessive frictional forces, thus desirably minimizing the force required for rapidly accelerating the strap. As noted, strap is withdrawn from the accumulator by passage through one of the sidewalls (i.e., sidewall 22 in the embodiment illustrated), with the "lifting" effect achieved attendant to movement of the strap along inclined guide ramp 50 desirably acting to reduce "layer-to-layer" friction between different portions of the continuous strap within the accumulator 18.

As will be appreciated, a strap accumulator embodying the principles of the present invention can be readily sized and configured for maximizing the efficiency of the particular strapping apparatus 10 with which the accumulator is being used. Generally speaking, however, the relative positioning of the strap guide 44 within the accumulator housing, and the relative dimensions of the strap guide 44 and the accumulator cavity, are determined by the size of the strap loop that can be formed without permanently deforming the strap at its "front" or apex. Further, the diameter of the strap guide is selected by employing the minimum diameter about which the strap material can be wound without inducing curl in the material. Dimensioning of the strap guide 44 is also determined by the length of the inclined guide ramp 50 which is required for a given strap width to permit the strap material to be guided or "raised" completely out of the confines of the housing sidewalls 22 and 24. The various above-discussed positions and dimensions are, of course, dependent to some extent upon, inter alia, the strap material, thickness, and width.

From the foregoing, it will be observed that numerous modifications and variations can be effected without departing from the true spirit and scope of the novel concept of the present invention. It will be understood that no limitation with respect to the specific embodiment illustrated herein is intended or should be inferred. It is, of course, intended to cover by the appended claims all such modifications as fall within the scope of the claims.

What is claimed is:

1. An accumulator for receiving continuous strap from an associated strap dispensing means, and for accumulating strap for periodic withdrawal from the accumulator by an associated strapping apparatus, comprising:

an accumulator housing having a pair of spaced-apart sidewalls, and an edge wall extending therebetween to define a cavity within said housing, said housing defining an infeed opening between said sidewalls through which strap is fed into said cavity by said associated dispensing means; and strap guide means positioned generally within said cavity of said housing, said guide means being configured to receive said continuous strap from within said cavity and to guide said strap from within said cavity through one of said housing sidewalls when said strap is withdrawn from the accumulator by said associated strapping apparatus, said strap guide means defining a mouth which receives said continuous strap from within said cavity, said mouth including a guide surface along which strap is drawn as said guide means receives and guides said continuous strap from within said cavity, said strap guide means being configured and positioned within said cavity of said housing relative to said infeed opening so that strap which is fed into said cavity by said associated dispensing means forms a single loop of strap defining an apex which advances about the periphery of said strap guide means attendant to infeeding of said continuous strap.

2. A strap accumulator in accordance with claim 1, including pressure switch means positioned between said housing sidewalls whereby said pressure switch means further defines said cavity, said pressure switch means being operable in response to pressure exerted thereon by strap accumulated within said cavity to signal said strap dispensing means to discontinue feeding of strap into said cavity.

3. A strap accumulator in accordance with claim 1, wherein said guide means is generally circular and defines said mouth at the marginal edge portion thereof into which strap from within said cavity is directed for passage through said guide means, said guide surface of said mouth comprising at least one arcuately shaped guide surface along which said strap is moved during withdrawal of strap by said associated strapping apparatus.

4. A strap accumulator in accordance with claim 3, wherein said guide means further defines an inclined guide ramp communicating with said mouth for guiding said strap from said mouth outwardly of said cavity through said one sidewall.

5. A strap accumulator in acccrdance with claim 4, including guide bridge means mounted on said strap guide means and spanning said inclined guide ramp to confine said strap generally within said guide ramp as said strap is withdrawn by said associated strapping apparatus.

6. A strap accumulator in accordance with claim 4, wherein one of said sidewalls of said housing defines an opening to facilitate threading of a free end of said strap into said mouth of said guide means.

7. An accumulator for receiving continuous strap from associated strap dispensing means, and for accumulating strap for periodic withdrawal from the accumulator by an associated strapping apparatus, comprising:

an accumulator housing having a pair of parallel, spaced-apart sidewalls, and an arcuate edge wall extending between said sidewalls to define a cavity within said housing, said housing defining an infeed opening between said sidewalls through which strap is fed into said cavity by said associated strap dispensing means;

strap guide means fixedly mounted generally centrally of and within said cavity of said housing, said guide means being configured to receive accumulated strap from within said cavity and guide said strap for withdrawal by said associated strapping apparatus, said generally central mounting of said guide means within said cavity permitting a loop of said strap to be formed within said cavity between said edge wall and said guide means and generally about said guide means attendant to feeding of said strap into said cavity by said associated strap dispensing means;

said strap guide means being generally circular and defining a mouth at the marginal edge portion thereof into which strap from within said cavity is directed for passage through said guide means, said mouth including an arcuately shaped guide surface having a decreasing radial dimension relative to a central point of said guide means along which said strap is drawn when said strap is withdrawn from the accumulator by said associated strapping apparatus, said strap guide means further defining inclined guide ramp means communicating with said mouth for guiding strap from within said cavity through one of said housing sidewalls when said strap is withdrawn from said accumulator, said strap guide means being positioned within said cavity of said housing relative to said infeed opening so that strap which is fed into said cavity by said associated strap dispensing means forms a single loop of strap defining an apex which advances about said strap guide means attendant to infeeding of said continuous strap to permit formation of said single strap loop about the periphery of said strap guide means; and pressure switch means positioned between said sidewalls, said pressure switch means being operable in response to pressure exerted thereon by strap accumulated within said cavity to signal said strap dispensing means to discontinue feeding of strap into said cavity.

8. A strap accumulator in accordance with claim 7, wherein said pressure switch means is mounted for pivotal movement between said housing sidewalls.

9. An accumulator in accordance with claim 7, including guide bridge means mounted on said strap guide means and spanning said inclined guide ramp means to confine said strap generally with said guide ramp means as said strap is withdrawn by said associated strapping apparatus.

10. An accumulator in accordance with claim 7, including infeed guide means positioned generally between said housing sidewalls in closely spaced relation to said housing edge wall to further define said infeed opening whereby strap is fed into said cavity along said edge wall.

* * * * *